US006904922B2

(12) United States Patent
Tsai

(10) Patent No.: US 6,904,922 B2
(45) Date of Patent: Jun. 14, 2005

(54) LUMINOUS UMBRELLA

(75) Inventor: Ting-Sheng Tsai, Kaohsiung Hsien (TW)

(73) Assignee: Wei-Sin Chang, Taipei (TW)

( * ) Notice: Subject to any disclaimer, the term of this patent is extended or adjusted under 35 U.S.C. 154(b) by 49 days.

(21) Appl. No.: 10/670,315

(22) Filed: Sep. 26, 2003

(65) Prior Publication Data

US 2005/0067003 A1 Mar. 31, 2005

(51) Int. Cl.[7] ..... A45B 3/02
(52) U.S. Cl. ..... 135/16; 135/910; 362/102
(58) Field of Search ..... 135/910, 16; 362/102

(56) References Cited

U.S. PATENT DOCUMENTS 5,323,798 A * 6/1994 Yang ..... 135/16
5,502,624 A * 3/1996 Tu ..... 362/102
6,089,727 A * 7/2000 Wu ..... 362/102
6,126,293 A * 10/2000 Wu ..... 362/102

* cited by examiner

*Primary Examiner*—Robert Canfield
(74) *Attorney, Agent, or Firm*—Rosenberg, Klein & Lee

(57) ABSTRACT

A luminous umbrella includes a power source, a switch, an electric wire, light emission objects, connectors and light permeable rods adapted to the umbrella comprised of a handle, a shank, ribs, spreaders, and a canopy with the power source and the switch contained in the handle. The power source is connected to the electric wire via the switch. The electric wire is placed inside the shank and the ribs and connected to the light emission objects. Each of the ribs has a U-shaped profile with its U-shape opening side attached flush on the canopy for the canopy to conceal the electric wire put inside the rib. Another end of each of the light permeable rods is exposed out of the canopy.

3 Claims, 4 Drawing Sheets

LUMINOUS UMBRELLA

BACKGROUND OF THE INVENTION (a) Field of the Invention

The present invention relates to a luminous umbrella, and more particularly, to one that a light emission object, a connector and a light permeable rod are provided to each rib for the outer section of each rib to become luminous.

(b) Description of the Prior Art

A conventional umbrella is essentially comprised of a handle, a shank, multiple spreaders, multiple ribs and a canopy. The handle is connected to one end of the shank, and another end of the shank is connected to one end of each of the ribs. The shank is inserted by the spreaders, and another end of each spreader is pivoted to the respective rib. The canopy is fixed onto the ribs. The ribs are stretched out or closed in by pushing the spreaders to slide along the shank. A luminous umbrella of the prior is further provided with a power source and a switch in the handle and the power source is connected to electric wire through the switch generally available in any of the following configurations:

1. The handle is provided with a light emission object to become a flashlight.
2. An electric wire is put inside the shank and a single light emission object is provided at the top of the shank and exposed out of the canopy.
3. An electric wire is put inside the shank and the ribs, and a light emission object is connected to the tip of each rib.

However,

1. The handle functions to its best as a flashlight. In a rainy night, the light emitted from the flashlight reaches only the area right under the handle, instead of the area ahead of the user, making the luminous handle useless at all. Furthermore, the light from the flashlight relates to a single beam pointing only to one direction (usually in conic coverage), and the range covered is very short (not longer than three meters); therefore, it gives a very poor alerting effect to a driver at a farther distance or approaching from either side of the pedestal holding the umbrella.
2. The purpose of having provided at the top of the shank is to alert approaching drivers, not for lighting or decoration purpose; however, the single point light emission fails to mark the range of the pedestrian holding the umbrella; and this configuration lacks in safety since any careless driver could approach too close to the pedestrian.
3. The purpose of having provided a light emission object on the tip of each rib is for alerting or for decoration, again, the single point light has a weak coverage and gives its alerting effect only the approaching vehicle gets closer to the pedestrian while the decoration effect is also not so prominent.

Therefore, either for lighting, alerting or decoration, the prior art of a luminous umbrella fails any, or even all of its expected results.

SUMMARY OF THE INVENTION

The primary purpose of the present invention is to provide a luminous umbrella that achieves all the purposes of safety alerting, lighting, and decoration with fun. To achieve the purpose, the present invention includes a power source, a switch, an electric wire, light emission objects, connectors and light permeable rods adapted to the umbrella; and the umbrella includes a handle, a shank, spreaders, ribs and a canopy. Wherein, the handle is connected to one end of the shank, another end of the shank is pivoted to one end of each of the ribs, one end of each spreader is separately inserted to the shank, and another end of each of the spreaders is pivoted to the respective rib. Each rib has a U-shape profile, and the canopy is fixed over the ribs. By pulling the spreaders along the shank, the ribs are stretched out or closed in. The power source and the switch are provided in the handle, the power source is connected to the electric wire through the switch, the electric wire is placed inside the shank and the ribs, and connected to the light emission objects. Each of the light emission objects is provided on the other end of the rib with the U-shape opening of the rib attached flush on the canopy to conceal the electric wire in the rib; and each of the connectors is a tube with two hollow ends having one end inserted to the other end of the respective rib and the light emission object, and another end of the connector inserted to one end of the respective light permeable rod. The light permeable rods hold the canopy in position with another end of each of the light permeable rods exposed out of the canopy.

DETAILED DESCRIPTION OF THE PREFERRED EMBODIMENTS

Figure 1:
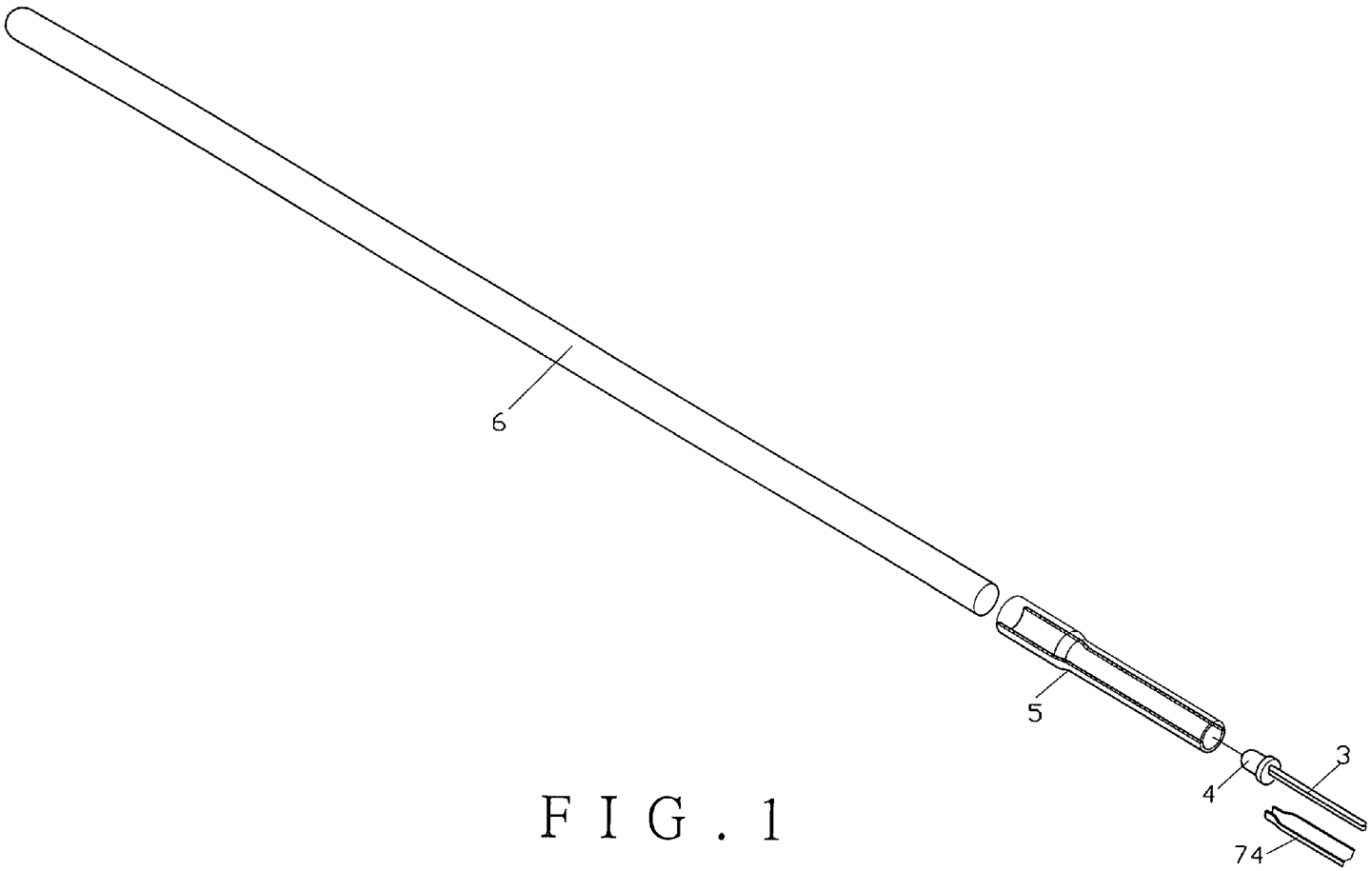
FIG. 1 is an exploded view of a preferred embodiment of the present invention.
Figure 2:
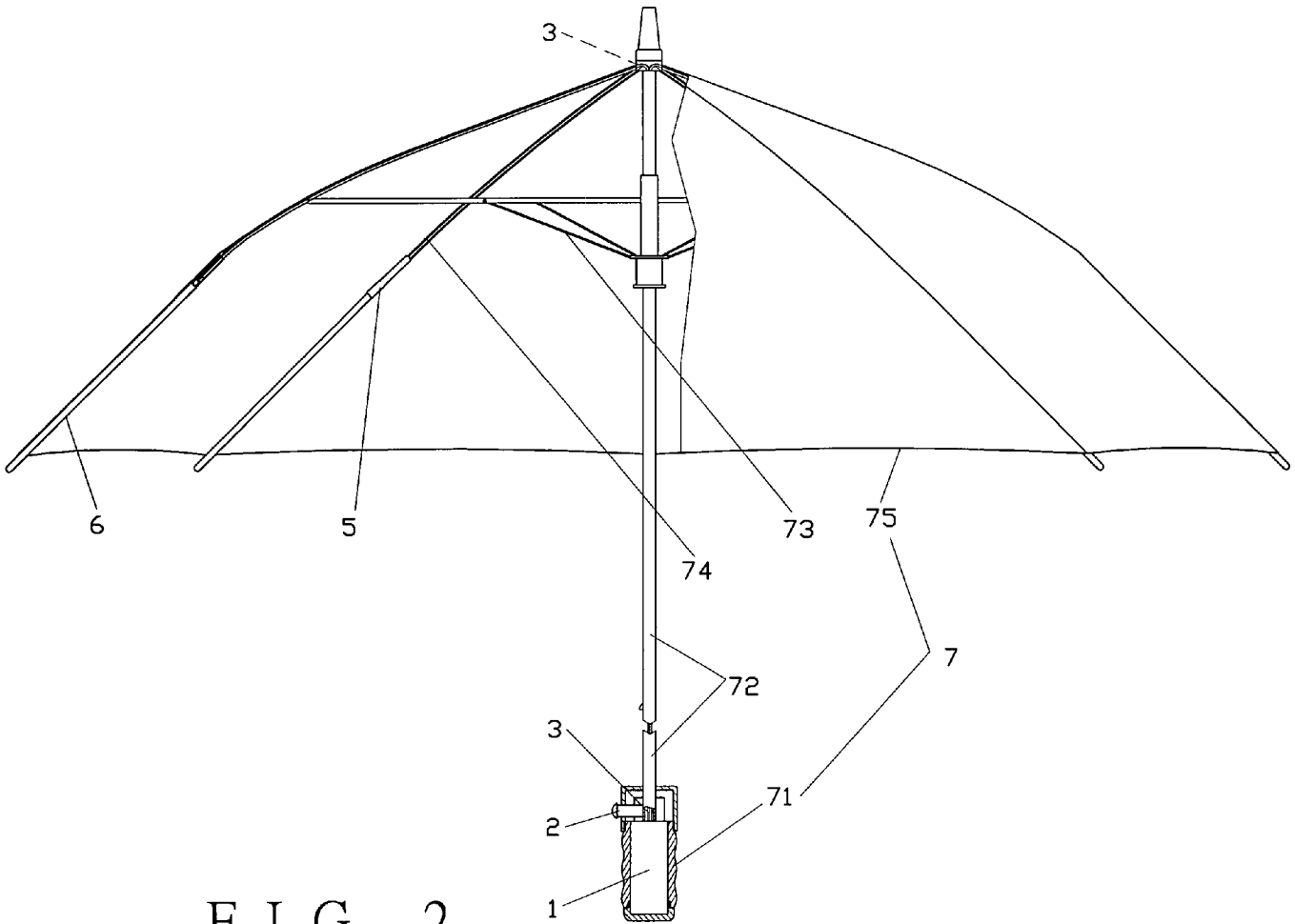
FIG. 2 is a view showing the preferred embodiment of the present invention as assembled.

Referring to FIGS. 1 and 2, a preferred embodiment of the present invention includes a power source (1), a switch (2), an electric wire (3), light emission objects (4), connectors (5) and light permeable rods (6) adapted to an umbrella (7) including a handle (71), a shank (72), multiple spreaders (73), multiple ribs (74), and a canopy (75). Wherein, the handle (71) is connected to one end of the shank (72), another end of the shank (72) is pivoted to one end of each of the ribs (74), and the canopy (75) is held in position by the ribs (74). By pulling a ring that supports all the spreaders (73) along the shank (72), the ribs (74) are stretched out or closed in. The power source (1) and the switch (2) are provided in the handle (71) and the power source (1) is connected to the electric wire (3). The electric wire (3) is placed inside the shank (72) and each of the ribs (74) and connected to the light emission objects (4).

Each light emission object (4) is provided in the other end of each rib (74). As illustrated in FIG. 4, the profile of the rib (74) indicates a U-shape with its opening attached flush on the canopy (75) while the electric wire (3) in the rib (74) is concealed under the canopy (75). Each connector (5) is a tube having two hollow ends with one end inserted to the other end of the corresponding rib (74) and the light emission object (4), and another end of the connector (5) is inserted to one end of the light permeable rod (6). The light permeable rods (6) hold the canopy (75) in position with another end of each of the light permeable rods (6) exposed outside of the canopy (75) as illustrated in FIGS. 2 and 3.

Figure 3:
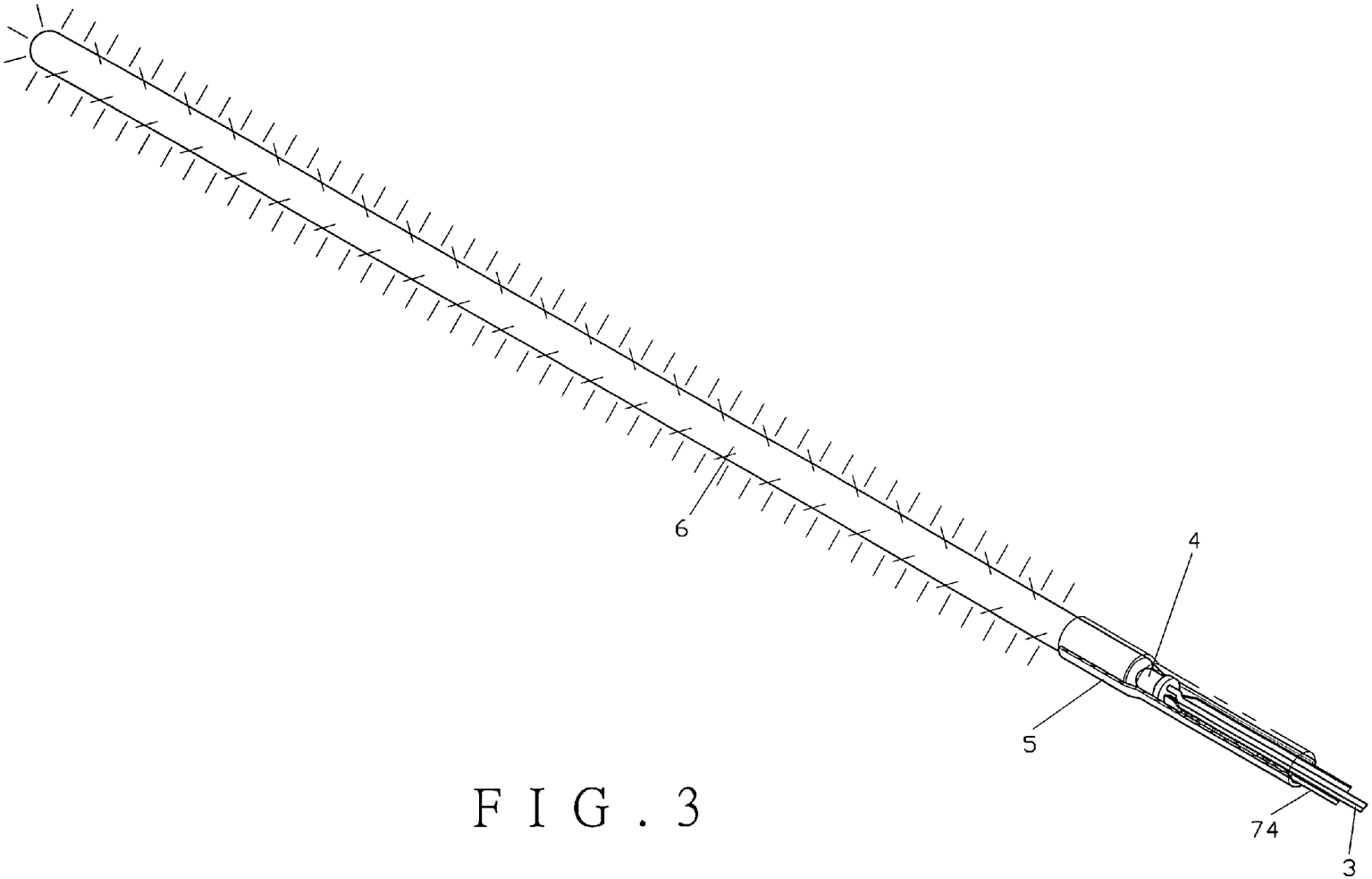
FIG. 3 is a perspective view showing the operation of the preferred embodiment of the present invention.
Figure 4:
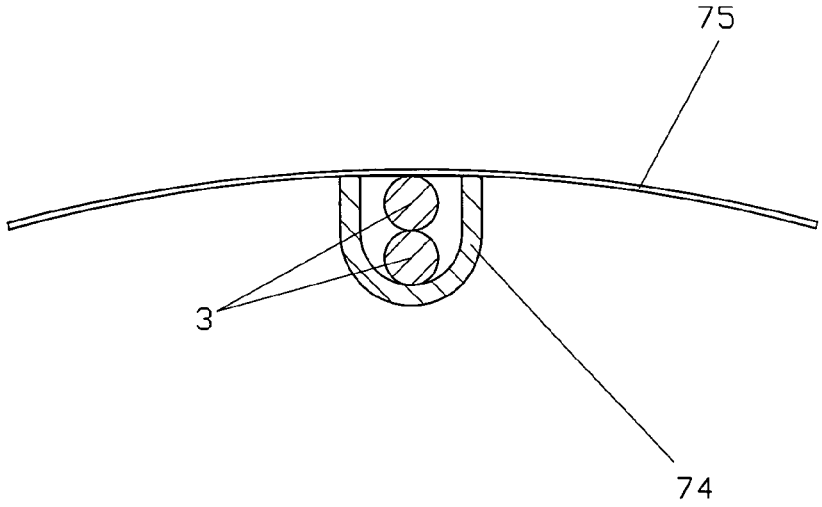
FIG. 4 is a crossed sectional view of the preferred embodiment of the present invention.

Now referred to FIG. 3, when the light emission objects (4) are turned on, the entire light permeable rods (6) are illuminated making the entire range of the umbrella (7) specifically market for alerting purpose. A pedestrian holding the umbrella (7) can be easily seen by drivers far away; meanwhile, as the entire light permeable rods (6) are illuminated, the conic coverage under the umbrella (7) is lighted to give good eyesight for the pedestrian holding the umbrella (7). While giving its functions of safety and lighting, the light permeable rods (6) provide better visual effects to add the fun of decoration purpose. Furthermore, the ribs (74) by having its U-shape opening attached flush on the canopy (1) conceal and protect the electric wire (3) while improving the attractive appearance of the umbrellas as a whole.

I claim:

1. A luminous umbrella including a power source, a switch, an electric wire, light emission objects, connectors, and light permeable rods adapted to the umbrella; the umbrella including a handle, a shank, a plurality of spreaders, a plurality of ribs and a canopy; the handle being connected to one end of the shank; another end of the shank being pivoted to one end of each of the ribs; the spreaders being supported by a ring inserted on the shank; another end of each of the spreaders being pivoted to the respective rib; the ribs holding the canopy in position; the ribs being stretched out or closed in by pulling the ring along the shank; the power source and the switch being provided in the handle; the power source being connected to the electric wire via the switch; and the electric wire being placed inside the shank and each of the ribs, and connected to the light emission objects;

each light object emission being provided at one end of a respective rib; connector tubes each having two hollow ends; one end of each connector tube being connected to the one end of the respective rib and the light emissive object; another end of each connector tube being connected to one end of a respective light permeable rod; and all the light permeable rods holding the canopy in position.

2. A luminous umbrella as claimed in claim 1, wherein, each rib has a U-shaped profile with its U-shape opening side attached flush on the canopy for the canopy to conceal the electric wire put inside the rib.

3. A luminous umbrella as claimed in claim 1, wherein, another end of each of the light permeable rods is exposed out of the canopy.

* * * * *